United States Patent [19]

Honig

[11] Patent Number: 4,572,964

[45] Date of Patent: Feb. 25, 1986

[54] COUNTERPULSE RAILGUN ENERGY RECOVERY CIRCUIT

[75] Inventor: Emanuel M. Honig, Los Alamos, N. Mex.

[73] Assignee: The United States of America as represented by the United States Department of Energy, Washington, D.C.

[21] Appl. No.: 655,490

[22] Filed: Sep. 28, 1984

[51] Int. Cl.[4] ..... H03K 3/00

[52] U.S. Cl. ..... 307/106; 307/108; 124/3; 89/8

[58] Field of Search ..... 307/106, 108; 124/3; 89/8

[56] References Cited

U.S. PATENT DOCUMENTS

| | | | |
|---|---|---|---|
| 4,369,691 | 1/1983 | Baehr, Jr. et al. | 89/8 |
| 4,369,692 | 1/1983 | Kemeny | 89/8 |
| 4,429,613 | 2/1984 | Deis et al. | 89/8 |
| 4,433,607 | 2/1984 | Kemeny | 89/8 |

OTHER PUBLICATIONS

"High Power Triggered Vacuum Gap of Rod Array Type", by Rich et al., GE Report No. 81CRD321, 12-1981.

"Progress in Developing Repetitive Pulse Systems Utilizing Inductive Energy Storage", by Honig, Los Alamos Lab. Report, LA-UR-83-1585, 4th IEEE Pulsed Power Conference, Jun. 1983.

"Switching Considerations and New Transfer Circuits for Electromagnetic Launch Systems", by Honig, IEEE Trans. Mag., vol. MAG-20, No. 2, Mar. 1984, pp. 312-315.

"An Electromechanical Capacitor for Energy Transfer", by Carroll et al., 4th IEEE Pulsed Power Conf., Albuquerque, N.M., Jun. 6-8, 1983, IEEE Pub. No. 83CH1908-3, pp. 435-438.

*Primary Examiner*—Harry E. Moose, Jr.
*Assistant Examiner*—Derek S. Jennings
*Attorney, Agent, or Firm*—Leonard C. Brenner; Paul D. Gaetjens; Judson R. Hightower

[57] ABSTRACT

In an electromagnetic launcher such as a railgun for propelling a projectile at high velocity, a counterpulse energy recovery circuit is employed to transfer stored inductive energy from a source inductor to the railgun inductance to propel the projectile down the railgun. Switching circuitry and an energy transfer capacitor are used to switch the energy back to the source inductor in readiness for a repetitive projectile propelling cycle.

7 Claims, 9 Drawing Figures

COUNTERPULSE RAILGUN ENERGY RECOVERY CIRCUIT

This invention is the result of a contract with the Department of Energy (Contract No. W-7405-ENG-36).

BACKGROUND OF THE PRESENT INVENTION

The present invention relates generally to a high-power pulsing circuit and more particularly to a repetitive pulse inductive energy storage and transfer circuit for an electromagnetic launcher.

Electromagnetic launchers are generating considerable interest because their projectile launch velocities are not limited to the sonic velocity of an expanding gas, as in conventional guns. In the railgun, the simplest and most successful type of electromagnetic launcher, a projectile sliding between two parallel rails acts as a sliding switch or electrical short between them. By passing a large current down one rail, through the projectile (or a conducting sabot or plasma behind it), and back along the other rail, a large magnetic field is built up behind the projectile, accelerating it to a high velocity by the force of the current times the magnetic field. Projectile velocities over 10 kilometers per second can be obtained by this method.

Electromagnetic launchers of the railgun type have the problem that the launch process is inefficient. Even under the ideal conditions of constant-current drive and no dissipative losses, only one-half of the energy extracted from the power source is transferred to the projectile. The remainder goes into building up the magnetic field behind the projectile or, equivalently, into energizing the railgun inductance. If the energy stored in the inductance of the rails is not recovered after each launch operation, then it will be dissipated (in the rail resistance and in a muzzle blowout arc). Under these conditions, therefore, the best operational efficiency (projectile energy/power supply energy delivered) that repetitive railguns can achieve is 50 percent. Of course, dissipative losses in switches, the rail resistance, or a plasma arc behind the projectile only serve to reduce the operational efficiency below this limit.

One possibility for utilizing the inductively-stored rail energy is the breech crowbar circuit which uses a crowbar switch at the breech of the railgun to crowbar or short circuit the driving power supply when the projectile has reached some fraction of its launch velocity. Thereafter, the projectile is further accelerated by the expansion of the magnetic field trapped in the railgun behind the projectile. Unfortunately, the barrel length has to be doubled to convert one-half of the trapped magnetic energy to projectile kinetic energy and quadrupled to convert 75% of the trapped energy (assuming no dissipative losses). While technically feasible, the breech crowbar scheme results in a very large increase in railgun barrel length and never recovers all of the trapped energy.

High pulse power repetitive pulse inductive storage circuits have been disclosed in applications Ser. No. 617,653 and Ser. No. 617,658 both filed on June 5, 1984. These applications illustrate some advantages of repetitive pulse inductive storage circuits and describe the type of switches that can be used therewith. These applications are incorporated by reference.

Therefore, it is an object of the present invention to provide a high-power energy transfer circuit with the capability to recover energy stored in the inductance of the load.

It is another object of the present invention to provide a repetitive energy transfer and recovery circuit.

It is another object of the present invention to provide an efficient energy transfer and recovery circuit using survivable switches.

It is still another object of the present invention to provide an energy transfer circuit for railgun electromagnetic launchers which can recover the energy from the load inductance without increasing the barrel length over that required for normal acceleration.

SUMMARY OF THE INVENTION

To achieve the foregoing and other objects, and in accordance with the purpose of the present invention, as embodied and broadly described herein, the counterpulse railgun energy recovery circuit of the present invention includes a source inductor and an energy transfer capacitor coupled to the load inductance of a railgun. Switches including a muzzle switch are provided to switch stored inductive energy from the source inductor to the load inductance to fire a projectile down the railgun. The inductive energy is then switched back to the source inductor for a repetitive cycle.

An advantage of the present invention is that efficient energy recovery is provided for repetitive cycling of the railgun operation.

Another advantage of the present invention is that the railgun need not be extended to lengths greater than required for desired projectile velocity.

Still another advantage is that the transfer capacitor, being charged in series with the load, is not restricted to the requirement that its voltage track the railgun breech voltage.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE PREFERRED EMBODIMENT

Figure 1:
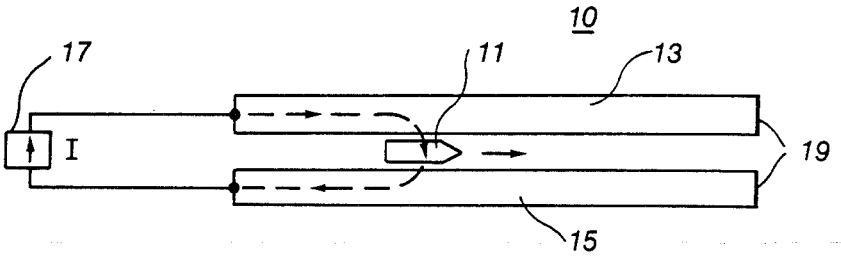
FIG. 1 is an illustration of a railgun electromagnetic launcher suitable for use with the present invention.

In accordance with the present invention, an electromagnetic railgun 10 includes a projectile 11 sliding between a first rail 13 and a parallel second rail 15, see FIG. 1. The projectile 11 acts as a sliding switch or electrical short between the rails 13 and 15. By passing a large current I generated by a current source 17 down the first rail 13 through the projectile 11 and back along the second rail 15, a large magnetic field B is built up behind the projectile 11 accelerating it to a high velocity by the $I \times B$ force. The projectile 11 will exit the railgun 10 at its muzzle end 19. A conducting projectile 11 can withstand the driving current I for only a limited time before it will melt. Longer launch times and, therefore, higher launch velocities can be achieved if the return current path between the rails is through a plasma (not shown) confined to a small region immediately behind the projectile 11.

Figure 2:
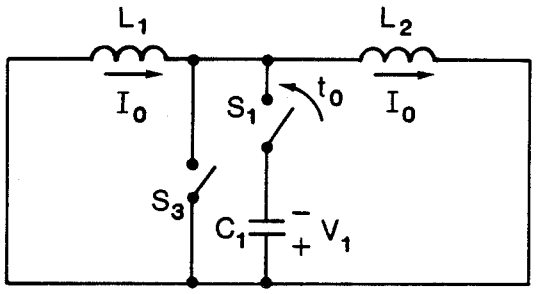
FIG. 2 is a schematic of a resonant circuit for energy recovery from a load inductance such as an electromagnetic railgun launcher.

Energy recovery in the present invention is achieved through resonant circuitry, see FIG. 2. When the projectile 11 has reached its required velocity or haas exited the railgun (whichever comes first), a crowbar switch (not shown) across the muzzle end 19 of the railgun is closed. At that instant $I_0$ represents the current flowing through a storage inductor $L_1$ and the inductance $L_2$ of the railgun. By connecting at this time to a precharged transfer capacitor $C_1$ across the inductor $L_1$ and inductance $L_2$, a resonant circuit condition is set thus causing the current in the railgun inductance $L_2$ to oscillate through zero. Preferably, the capacitor value $C_1$ and voltage $V_1$ are chosen so that the capacitive energy $E_C$ will have been expended at the same time that the load inductive energy $E_{L2}$ is zero. All the system energy can then be trapped in the storage inductor $L_1$ by closing the switch $S_3$ at the instant the energy in transfer capacitor $C_1$ and railgun inductance $L_2$ is zero.

The initial capacitive energy $E_c$ required to cause a zero current in the railgun inductance $L_2$ is given by:

$$E_c=(1+L_2/L_1)E_{L2}$$

where $E_{L2}$ is the inductive energy in $L_2$.

Figure 3:
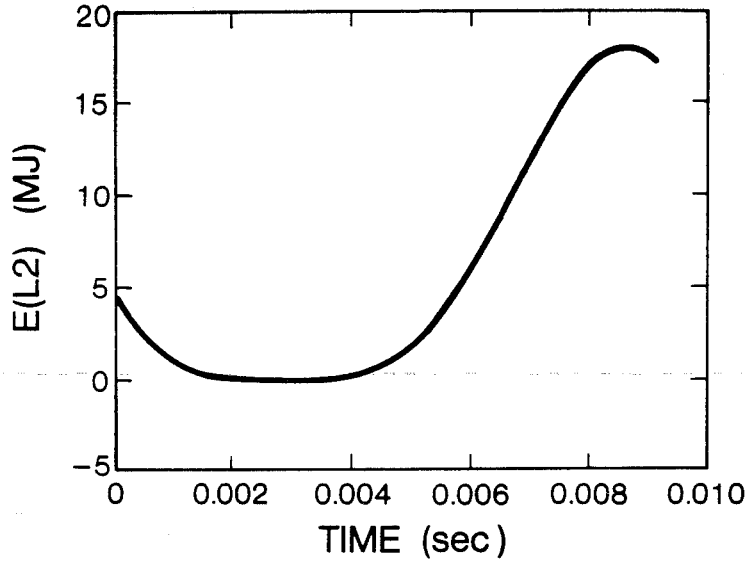
FIG. 3 is a plot of energy variation in the load inductance of FIG. 2.
Figure 4:
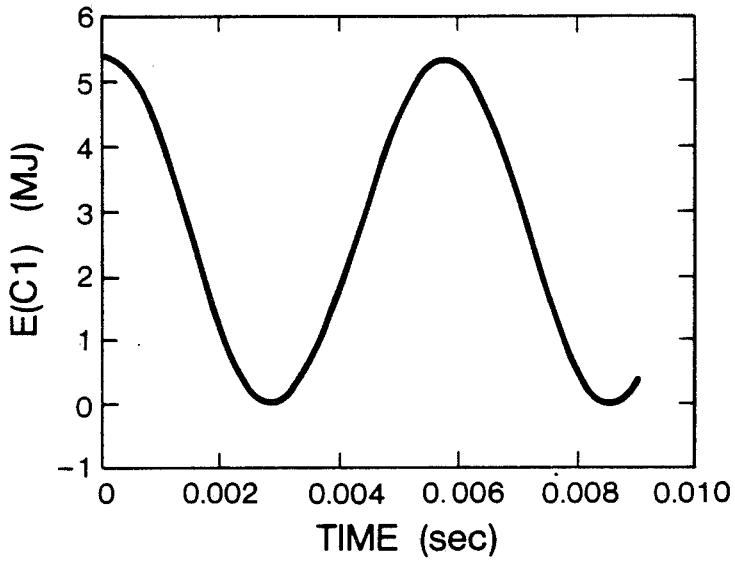
FIG. 4 is a plot of energy variation in an energy transfer capacitor used in the circuit of FIG. 2.

With $C_1$ charged to $V_1$ and sufficient energy $E_C$, the current in the railgun inductance $L_2$ will be driven quickly to zero in a manner identical to the counterpulse technique for opening switches. Plots of energy variation in megajoules employing this counterpulse method are shown in FIG. 3 for the railgun inductance $L_2$ and FIG. 4 for the transfer capacitor $C_1$. Closing switch $S_3$ at the time when both $E_{L2}$ and $E_{C1}$ are zero traps all the system energy back in storage inductor $L_1$. Thereafter, $E_{L2}$ and $E_{C1}$ would be zero, instead of as shown in FIGS. 3 and 4.

Figure 5:
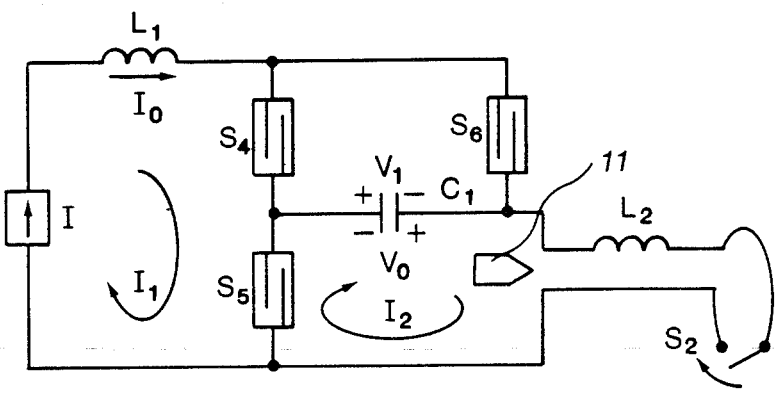
FIG. 5 is a schematic of the counterpulse railgun energy recovery circuit of the present invention.

In accordance with the present invention, a repetitive energy transfer and energy recovery circuit uses only four switches and employs a counterpulse technique for both switch opening and energy recovery, see FIG. 5. Switches $S_4$, $S_5$, and $S_6$ are shown as rod array triggered vacuum gap (TVG) switches, but other current-zero switches with sufficient ratings may be used. If cost is not an important factor, a solid-state silicon controlled rectifier (SCR) switch array could be considered. If $S_4$ and $S_5$ have a high conduction drop (compared to solid-state switches), then a low-resistance bypass switch may be required in parallel with them if long conduction times are required. A source of current I is needed to initially charge source inductor $L_1$ to $I_0$. This source of current I does not have to be an ideal current source. The storage current $I_0$ initially flows through source inductor $L_1$, $S_4$, and $S_5$ (loop 1) and transfer capacitor $C_1$ is precharged to a voltage $V_0$. When the projectile is injected into the barrel, transfer capacitor $C_1$ discharges through the railgun (loop 2) to automatically counterpulse the current in switch $S_5$ to zero. With $S_5$ open, the current from source inductor $L_1$ flows through $S_4$ and transfer capacitor $C_1$ to drive the projectile while also reversing the polarity of transfer capacitor $C_1$. When transfer capacitor $C_1$ has been charged to a voltage $V_1$ and energy slightly greater than $(1+X)E_{L2final}$ (where $X=L_{2final}/L_1$), switch $S_6$ is closed to bypass transfer capacitor $C_1$ and automatically counterpulse $S_4$ off. After the projectile 11 has reached the desired velocity, the muzzle crowbar switch $S_2$ is closed to terminate the launch acceleration. The circuit is then placed into the resonant energy recovery mode by closing switch $S_5$. This allows transfer capacitor $C_1$ to counterpulse the current in $L_{2final}$ to zero and return the load inductive energy to source inductor $L_1$, as discussed earlier. By slightly delaying the closing of $S_4$ when trapping the system energy in source inductor $L_1$, the capacitor $C_1$ can be recharged to a voltage $V_0$ and the entire circuit returned to its original condition (except for the energy imparted to the projectile).

As an example for a railgun 10 having rails 13 and 15 four meters in length with an inductance of 0.5 $\mu$H/m, a projectile mass of 2 kg, a capacitor of 0.5 F at 2 kV, an initial current $I_0$ of 1 megampere, and a storage inductor of 200 $\mu$H with an initial storage energy of 100 megajoules. The ratio of initial stored energy to final projectile energy of 100:1 provides for constant current during launch, simplifying the analysis of the launch process. Operational systems are likely to use a smaller storage inductor, with an energy ratio probably between 5:1 and 10:1. To compensate for the decrease in drive current during the launch, such systems would have to increase the railgun 10 length to allow a longer launch time to achieve the same final velocity as in the constant-current case.

Figure 6:
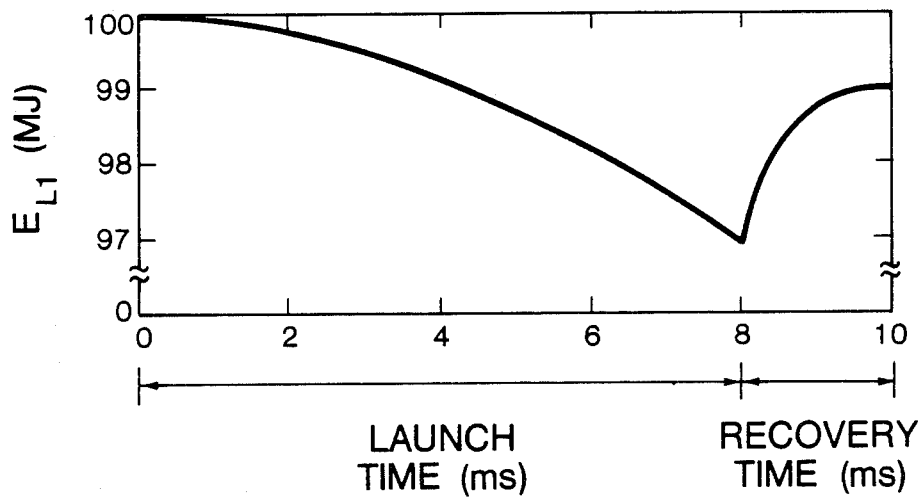
FIG. 6 is a waveform diagram of the energy in the source inductor $L_1$ in the circuit of FIG. 5.
Figure 7:
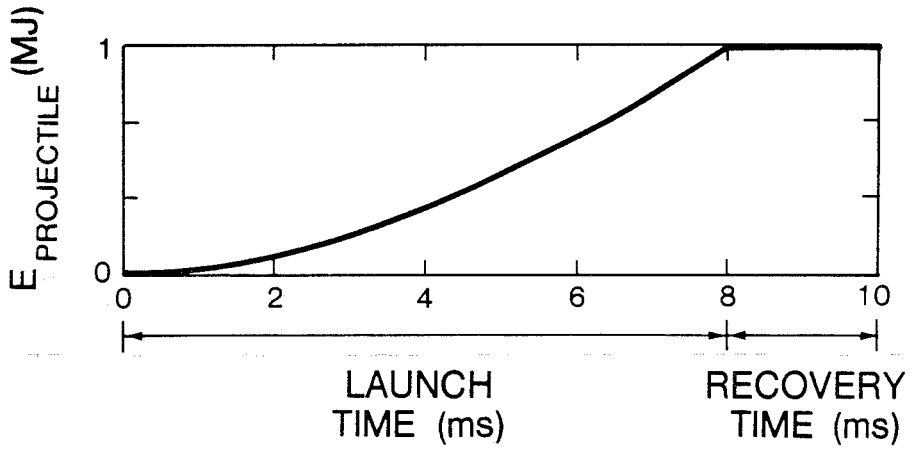
FIG. 7 is a waveform diagram of the energy in the projectile fired by the circuit of FIG. 5.
Figure 8:
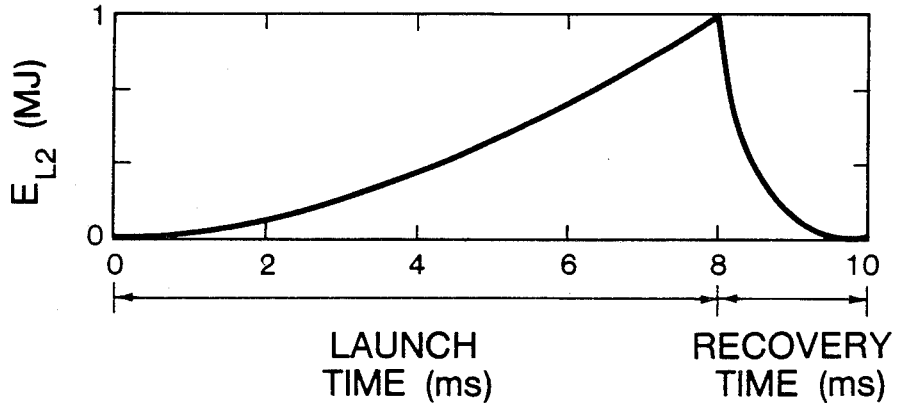
FIG. 8 is a waveform diagram of the energy in the load inductance of the circuit of FIG. 5.
Figure 9:
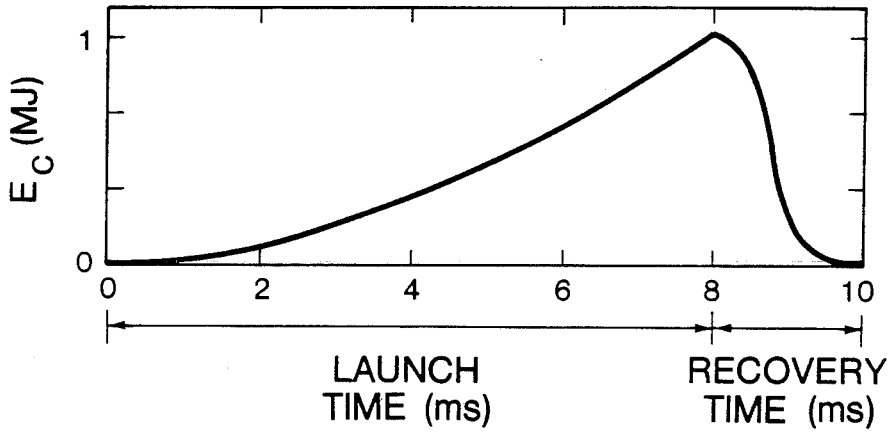
FIG. 9 is a waveform diagram of the energy in the transfer capacitor $C_1$ of the circuit of FIG. 5.

The above components will yield a projectile 11 launch velocity of 1 km/s with a projectile kinetic energy ($E_{projectile}$) of 1 megajoule (1 MJ). Under constant current conditions the launch time will be 8 ms with a railgun 10 length of 4 meters. The resistance of the rails 13 and 15 was assumed to be zero to illustrate the launch and energy recovery process more clearly FIG. 6 shows the value of inductive energy storage $E_{L1}$ in megajoules in the storage inductor $L_1$; FIG. 7 shows the energy in megajoules of the projectile 11; FIG. 8 shows the railgun energy $E_{L2}$ in megajoules in the railgun inductance $L_2$; and FIG. 9 shows the capacitive transfer energy $E_c$ in megajoules in the transfer capacitor $C_1$.

A current-zero type switch is needed for switches $S_2$, $S_4$, $S_5$, and $S_6$. The rod array TVG switch is an excellent candidate for this switch since the energy recovery cycle takes only a few milliseconds. Rod array TVG's are available from the General Electric Company, see General Electric Report No. 81CRD321. Alternatively, solid-state switch arrays may be suitable.

Other suitable switches are described in U.S. patent applications Ser. No. 617,653 and Ser. No. 617,658 filed June 5, 1984. See also, E. M. Honig, "Switching Considerations and New Transfer Circuits for Electromagnetic Launch Systems," IEEE Trans. Magn., Vol. MAG-20, No. 2, Mar. 1984, pp 312–315, hereby incorporated by reference.

The energy transfer capacitor $C_1$ may be fabricated as an electromechanical capacitor, see. T. A. Carroll, P. Chowdhuri, and J. Marshall, "An Electromechanical Capacitor for Energy Transfer," Proc. 4th IEEE Pulsed Power Conf., Albuquerque, NM, June 6–8, 1983, IEEE Pub. No. 83CH1908-3, pp. 435–438.

The theoretical basis for the above described counterpulse railgun energy recovery circuit is disclosed in the Los Alamos National Laboratory Report LA-10238-T, Chapter 6, herewith incorporated by reference.

The foregoing description of the preferred embodiments of the invention have been presented for purposes of illustration and description. It is not intended to be exhaustive or to limit the invention to the precise form disclosed, and obviously many modifications and variations are possible in light of the above teaching. As an example, the load is shown as a nonlinear, time-varying resistance and inductance, but the energy recovery scheme is just as applicable to loads with fixed inductances. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A counterpulse railgun energy recovery circuit for propelling a projectile along a railgun, said counterpulse railgun energy recovery circuit comprising:

a railgun having an effective inductance, said railgun having a breech end, a first and a second rail in parallel, and a muzzle end;

a source inductor initially charged to an initial current, said source inductor having a first end and a second end;

current means for initially charging said source inductor to said initial current, said current means having a first end connected to said first end of said source inductor and a second end connected to said second rail of said railgun at said breech end thereof;

first current-zero type switching means having a first end connected to said second end of said source inductor and a second end;

second current-zero type switching means having a first end connected to said second end of said first current-zero type switching means and a second end connected to said second rail of said railgun at said breech end thereof;

third current-zero type switching means having a first end connected to said second end of said source inductor and a second end connected to said first rail of said railgun at said breech end thereof;

muzzle current-zero type switching means having a first end connected to said first rail of said railgun at said muzzle end thereof and a second end connected to said second rail of said railgun at said muzzle end thereof;

transfer capacitive means having first and connected said second end of said first current-zero type switching means and a second end connected to said first rail of said railgun at said breech end thereof, said transfer capacitive means for cooperating with said first, second, third, and muzzle current-zero type switching means for providing a resonant circuit for transferring current from said source inductor to said effective inductance of said railgun during the propelling of a projectile along said railgun and for returning current from said effective inductance of said railgun to said source inductance after the projectile has exited said railgun.

2. The counterpulse railgun energy recovery circuit of claim 1 wherein said ratio of said source inductor to said effective inductance of said railgun is greater than about 5:1.

3. The counterpulse railgun energy recovery circuit of claim 2 wherein said ratio of said source inductor to said effective inductance of said railgun is in the order of 100:1.

4. The counterpulse railgun energy recovery circuit of claim 1 wherein said effective inductance of said railgun is on the order of 0.5 $\mu$H/meter and said railgun is on the order of 4 meters from said breech end to said muzzle end.

5. The counterpulse railgun energy recovery circuit of claim 4 wherein said ratio of said source inductor to said effective inductance of said railgun is greater than about 5:1.

6. The counterpulse railgun energy recovery circuit of claim 1 wherein said transfer capacitive means includes a transfer capacitor.

7. The counterpulse railgun energy recovery circuit of claim 6 wherein said transfer capacitor is on the order of 0.5 farads.

* * * * *